US010954465B2

(12) United States Patent
Barton

(10) Patent No.: US 10,954,465 B2
(45) Date of Patent: Mar. 23, 2021

(54) LUBRICATING COMPOSITION AND METHOD OF LUBRICATING DRIVELINE DEVICE

(71) Applicant: The Lubrizol Corporation, Wickliffe, OH (US)

(72) Inventor: William R. S. Barton, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 15/700,349

(22) Filed: Sep. 11, 2017

(65) Prior Publication Data

US 2017/0369810 A1 Dec. 28, 2017

Related U.S. Application Data

(63) Continuation of application No. 13/984,046, filed as application No. PCT/US2012/025159 on Feb. 15, 2012.

(60) Provisional application No. 61/443,329, filed on Feb. 16, 2011.

(51) Int. Cl.

| | |
|---|---|
| ***C10M 141/10*** | (2006.01) |
| ***C10M 169/04*** | (2006.01) |
| ***C10M 173/00*** | (2006.01) |
| ***C10M 163/00*** | (2006.01) |
| *C10N 10/02* | (2006.01) |
| *C10N 10/04* | (2006.01) |
| *C10N 20/04* | (2006.01) |
| *C10N 30/04* | (2006.01) |
| *C10N 30/06* | (2006.01) |
| *C10N 30/10* | (2006.01) |
| *C10N 30/00* | (2006.01) |
| *C10N 40/04* | (2006.01) |

(52) U.S. Cl.

CPC ..... *C10M 141/10* (2013.01); *C10M 163/00* (2013.01); *C10M 2207/124* (2013.01); *C10M 2207/26* (2013.01); *C10M 2207/262* (2013.01); *C10M 2215/086* (2013.01); *C10M 2219/044* (2013.01); *C10M 2219/046* (2013.01); *C10M 2223/043* (2013.01); *C10M 2223/049* (2013.01); *C10N 2010/02* (2013.01); *C10N 2010/04* (2013.01); *C10N 2020/04* (2013.01); *C10N 2030/04* (2013.01); *C10N 2030/06* (2013.01); *C10N 2030/10* (2013.01); *C10N 2030/44* (2020.05); *C10N 2030/52* (2020.05); *C10N 2030/54* (2020.05); *C10N 2040/04* (2013.01)

(58) Field of Classification Search

CPC ..... C10M 137/02; C10M 137/08
USPC ..... 508/286, 162, 315
See application file for complete search history.

(56) References Cited

U.S. PATENT DOCUMENTS

| | | | | |
|---|---|---|---|---|
| 4,237,022 A | 12/1980 | Barrer | | |
| 4,326,972 A | 4/1982 | Chamberlin, III | | |
| 4,952,328 A | 8/1990 | Davis et al. | | |
| 5,338,470 A * | 8/1994 | Hiebert | C10L 1/1817 | 508/452 |
| 2008/0108531 A1* | 5/2008 | Burrington | C10M 165/00 | 508/306 |

FOREIGN PATENT DOCUMENTS

| | | |
|---|---|---|
| GB | 2105743 A | 3/1983 |
| WO | 2005087904 | 9/2005 |
| WO | 2006044411 | 4/2006 |
| WO | 2008070307 | 6/2008 |
| WO | 2009101276 | 8/2009 |
| WO | 2010132318 | 11/2010 |
| WO | 2010141003 | 12/2010 |
| WO | 2011022263 | 2/2011 |
| WO | 2011022317 | 2/2011 |

OTHER PUBLICATIONS

European Patent Office, Written Opinion of Corresponding International Application No. PCT/US2012/025159 dated Apr. 19, 2012.
Corresponding International Publication No. WO 20121112635 A1 published Aug. 23, 2012.
Second Written Opinion of Corresponding International Application No. PCT/US2012/025159 dated Feb. 4, 2013.
European Patent Office, International Search Report of Corresponding International Application No. PCT/US2012/025159 dated Apr. 19, 2012.
European Patent Office, International Preliminary Report on Patentability of Corresponding International Application No. PCT/US2012/025159 dated May 14, 2013.

* cited by examiner

*Primary Examiner* — Prem C Singh
*Assistant Examiner* — Francis C Campanell
(74) *Attorney, Agent, or Firm* — Iken S. Sans; Teresan W. Gilbert

(57) ABSTRACT

The present invention relates to a lubricating composition containing: an oil of lubricating viscosity, a non-borated dispersant, a detergent, and an antiwear package comprising (a) a derivative of a hydroxycarboxylic acid, (b) an amine salt of a phosphoric acid ester, and (c) a phosphite having at least one hydrocarbyl group with 4 or more carbon atoms. The invention further provides for a method of lubricating a driveline device application by employing a lubricating composition containing the antiwear package.

10 Claims, No Drawings

LUBRICATING COMPOSITION AND METHOD OF LUBRICATING DRIVELINE DEVICE

FIELD OF INVENTION

The present invention relates to a lubricating composition containing: an oil of lubricating viscosity, a non-borated dispersant, a detergent, and an antiwear package comprising (a) a derivative of a hydroxycarboxylic acid, (b) an amine salt of a phosphoric acid ester, and (c) a phosphite having at least one hydrocarbyl group with 4 or more carbon atoms. The invention further provides for a method of lubricating a driveline device application by employing a lubricating composition containing the antiwear package.

BACKGROUND OF THE INVENTION

Oxidation of an oil of lubricating viscosity, especially an organic petroleum fluid, occurs in the presence of oxygen which leads to increased viscosity and sludge and/or deposit formation. Sludge and/or deposit formation is produced by a number of different mechanisms such as degradation of oil and decomposition products of lubricant additives. Using known lubricant additives containing an amine salt of a phosphorus compound such as many antiwear agents and friction modifiers is believed to contribute to the formation of sludge and/or deposit formation. The presence of sludge and other deposits interferes with seal performance leading to leakage and ultimately equipment failure for gears or bearings. However, many amine salts of phosphorus compounds also perform antiwear or extreme pressure functions.

One of the important parameters influencing durability or wear resistance of devices employing a lubricating composition is the effectiveness of phosphorus antiwear or extreme pressure additives at providing devices with appropriate protection under various conditions of load and speed. However, many of the phosphorus antiwear or extreme pressure additives contain sulphur. Due to increasing environmental concerns, the presence of sulphur in antiwear or extreme pressure additives is becoming less desirable. In addition, many of the sulphur-containing antiwear or extreme pressure additives evolve volatile sulphur species, resulting in lubricating compositions containing antiwear or extreme pressure additives having an odour, which may also be detrimental to the environment or evolve emissions that may be higher than increasingly tighter health and safety legislation specifies.

A lubricating composition having the correct balance of phosphorus antiwear or extreme pressure additives provides driveline power transmitting devices with prolonged life and efficiency with controlled deposit formation and oxidation stability. However, many of the antiwear or extreme pressure additives employed have at least one of (i) limited extreme pressure and antiwear performance over a wide range of operating conditions, (ii) limited oxidative stability, (iii) tendency to form deposits, or (iv) tendency to cause corrosion (for example copper corrosion). In addition, many phosphorus antiwear or extreme pressure additives typically contain sulphur, which results in an odorous lubricating composition containing the phosphorus antiwear or extreme pressure additives. A number of references disclosing antiwear chemistry are discussed below.

In addition, driveline devices often require certain frictional properties from a lubricant to provide the ability of the device to operate, e.g., a manual transmission to perform gear changes. For the gear change to be successful, the transmission must match the speeds of the input and output shafts. Matching of speeds may be accomplished by a synchronizer by which the synchronizing parts (plate to plate or ring to cone) are reduced to relative zero velocity. If these parts do not obtain zero relative velocity, then a phenomenon known as synchronizer clashing (sometimes referred to as crashing) occurs. Clashing of the synchronizer results when the dynamic coefficient of friction building between the engaging synchronizer parts (plate to plate or ring to cone) falls below a critical minimum value.

A number of publications generally disclose lubricants containing hydroxy carboxylic acid derivatives or carboxylic acid derivatives, typically for use an antiwear agent. The publications include International publications WO 2006/044411, WO 2005/087904, WO 2008/070307, and U.S. Pat. Nos. 4,326,972; 4,952,328; 5,338,470; and 4,237,022.

International publication WO2010/141003 discloses a driveline device lubricated with a composition containing a derivative of a hydroxycarboxylic acid and a phosphorus compound that may be either (i) a hydroxy-substituted di-ester of (thio)phosphoric acid, or (ii) a phosphorylated hydroxy-substituted di-or tri-ester of (thio)phosphoric acid.

International patent application PCT/US2010/045145 (based on U.S. Patent application Ser. No. 61/234,722, filed 18 Aug. 2009) discloses a method for lubricating a driveline device comprising supplying to the driveline device a lubricating composition comprising an oil of lubricating viscosity and an antiwear package wherein the antiwear package comprises (a) a derivative of a hydroxycarboxylic acid, and (b) a phosphorus compound selected from the group consisting of an amine salt of a phosphate hydrocarbon ester, a phosphite having at least one hydrocarbyl group with 4 or more carbon atoms, and mixtures thereof.

SUMMARY OF THE INVENTION

The inventors of this invention have discovered that a lubricating composition and method as disclosed herein is capable of providing acceptable levels of at least one of (i) wear, (ii) scuffing, (iii) fatigue, (iv) ridging, (v) extreme pressure performance, (vi) fuel economy/efficiency (typically improving fuel economy/efficiency), (vii) oxidation control (typically reducing or preventing oxidation), (viii) friction performance and (ix) deposit control. Improved wear or fatigue performance in a driveline device, including transmission or differential gears and/or bearings, is desirable.

In one embodiment the invention provides a lubricating composition comprising: an oil of lubricating viscosity, a non-borated dispersant, a detergent, and an antiwear package comprising (a) a derivative of a hydroxycarboxylic acid, (b) an amine salt of a phosphoric acid ester, and (c) a phosphite having at least one hydrocarbyl group with 4 or more carbon atoms.

In one embodiment the phosphorus compound may be an amine salt of a phosphoric acid hydrocarbon ester or mixtures thereof.

In one embodiment the derivatives of hydroxycarboxylic acid include imides, di-esters, di-amides, ester-amides derivatives of either tartaric acid or citric acid. Typically the derivatives of hydroxycarboxylic acid are imides, di-esters, di-amides, ester-amides derivatives of tartaric acid.

In one embodiment the invention provides a method of lubricating a mechanical device with a lubricating composition disclosed herein. The mechanical device may be a driveline device. The driveline device may be a manual transmission that may or may not contain a synchronizer system, or an axle. In one embodiment the driveline device contains a synchronizer, or axle. In one embodiment the driveline device contains a synchronizer.

The synchronizer system may have an operating surface comprising brass, carbon, molybdenum, phenolic resin, or a sintered metal (typically bronze), or mixtures thereof.

In different embodiments the lubricating compositions disclosed herein contain 0 ppm to 500 ppm, or 5 ppm to 300 ppm, or 20 ppm to 250 ppm of molybdenum.

In different embodiments the lubricating compositions disclosed herein may have a sulphur content of greater than 0.3 wt %, or 0.4 wt % to 5 wt %, or 0.5 wt % to 3 wt %, 0.8 wt % to 2.5 wt %, or 1 wt % to 2 wt % of the lubricating composition.

In one embodiment the invention provides for the use of a lubricating composition as disclosed herein for providing acceptable levels of at least one of (i) wear, (ii) scuffing, (iii) fatigue, (iv) ridging, (v) extreme pressure performance, (vi) fuel economy/efficiency (typically improving fuel economy/efficiency), (vii) oxidation control (typically reducing or preventing oxidation), (viii) friction performance and (ix) deposit control.

DETAILED DESCRIPTION OF THE INVENTION

The present invention provides a lubricating composition and a method for lubricating a driveline device as disclosed above.

Detergent

The detergent may be an overbased detergent, a non-overbased detergent, or mixtures thereof.

The preparation of a detergent is known in the art. Patents describing the preparation of overbased detergents include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

As used herein the TBN values quoted and associated range of TBN is on "an as is basis," i.e., containing conventional amounts of diluent oil which is used to handle viscosity. Conventional amounts of diluent oil typically range from 30 wt % to 60 wt % (often 40 wt % to 55 wt %) of the detergent component.

The detergent may be a non-overbased detergent (may also be referred to as a neutral detergent). The TBN of a non-overbased detergent may be 20 to less than 200, or 30 to 100, or 35 to 50 mg KOH/g. The TBN of a non-overbased detergent may also be 20 to 175, or 30 to 100 mg KOH/g. When a non-overbased detergent is prepared from a strong acid such as a hydrocarbyl-substituted sulphonic acid, the TBN may be lower (for example 0 to 50 mg KOH/g, or 10 to 20 mg KOH/g).

The detergent may be an overbased detergent, which may have a TBN of greater than 200 mg KOH/g (typically 250 to 600, or 300 to 500 mg KOH/g).

A more detailed description of the expressions "metal ratio", TBN and "soap content" are known to a person skilled in the art and explained in standard textbook entitled "Chemistry and Technology of Lubricants", Third Edition, Edited by R. M. Mortier and S. T. Orszulik, Copyright 2010, pages 219 to 220 under the sub-heading 7.2.5. Detergent Classification.

The detergent may be formed by the reaction of a basic metal compound and an acidic detergent substrate. The acidic detergent substrate may include an alkyl phenol, an aldehyde-coupled alkyl phenol, a sulphurised alkyl phenol, an alkyl aromatic sulphonic acid (such as, alkyl naphthalene sulphonic acid, alkyl toluene sulphonic acid or alkyl benzene sulphonic acid), an aliphatic carboxylic acid, a calixarene, a salixarene, an alkyl salicylic acid, or mixtures thereof.

The metal basic compound is used to supply basicity to the detergent. The basic metal compound is a compound of a hydroxide or oxide of the metal. Within the metal compound, the metal is typically in the form of an ion. The metal may be monovalent, divalent, or trivalent. When monovalent, the metal ion M may be an alkali metal, when divalent, the metal ion M may be an alkaline earth metal, and when trivalent the metal ion M may be aluminium. The alkali metal may include lithium, sodium, or potassium, or mixtures thereof, typically sodium. The alkaline earth metal may include magnesium, calcium, barium or mixtures thereof, typically calcium or magnesium.

Examples of metal basic compounds with hydroxide functionality include lithium hydroxide, potassium hydroxide, sodium hydroxide, magnesium hydroxide, calcium hydroxide, barium hydroxide and aluminium hydroxide. Suitable examples of metal basic compounds with oxide functionality include lithium oxide, magnesium oxide, calcium oxide and barium oxide. The oxides and/or hydroxides can be used alone or in combination. The oxides or hydroxides may be hydrated or dehydrated, although hydrated is typical. In one embodiment the metal basic compound may be calcium hydroxide, which may be used alone or mixtures thereof with other metal basic compounds. Calcium hydroxide is often referred to as lime. In one embodiment the metal basic compound may be calcium oxide which can be used alone or mixtures thereof with other metal basic compounds.

Collectively, when the alkyl phenol, the aldehyde-coupled alkyl phenol, and the sulphurised alkyl phenol are used to prepare a detergent, the detergent may be referred to as a phenate. The phenate may be an alkyl phenate, an aldehyde-coupled alkyl phenate, a sulphurised alkyl phenate, or mixtures thereof.

The TBN of a phenate may vary from less 200, or 30 to 175 typically 150 to 175) mg KOH/g for a neutral phenate to 200 or more to 500, or 210 to 400 (typically 230 to 270) mg KOH/g for an overbased phenate.

The alkyl group of a phenate (i.e., an alkyl phenate) may contain 4 to 80, or 6 to 45, or 8 to 20, or 9 to 15 carbon atoms.

In one embodiment the detergent may be a sulphonate, or mixtures thereof. The sulphonate may be prepared from a mono-or di-hydrocarbyl-substituted benzene (or naphthalene, indenyl, indanyl, or bicyclopentadienyl) sulphonic acid, wherein the hydrocarbyl group may contain 6 to 40, or 8 to 35 or 9 to 30 carbon atoms.

The hydrocarbyl group may be derived from polypropylene or a linear or branched alkyl group containing at least 10 carbon atoms. Examples of a suitable alkyl group include branched and/or linear decyl, undecyl, dodecyl, tridecyl, tetradecyl, pentadecyl, hexadecyl, heptadecyl, octadecyl, octadecenyl, nonodecyl, eicosyl, un-eicosyl, do-eicosyl, tri-eicosyl, tetra-eicosyl, penta-eicosyl, hexa-eicosyl or mixtures thereof.

In one embodiment the hydrocarbyl-substituted sulphonic acid may include polypropene benzenesulphonic acid and/or $C_{16}$-$C_{24}$ alkyl benzenesulphonic acid, or mixtures thereof.

In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). In some embodiments the linear alkyl group may be attached to the benzene ring anywhere along the linear chain of the alkyl group, but often in the 2, 3 or 4 position of the linear chain, and in some instances predominantly in the 2 position.

When neutral or slightly basic, a sulphonate detergent may have TBN of less than 100, or less than 75, typically 20 to 50 mg KOH/g, or 0 to 20 mg KOH/g.

When overbased, a sulphonate detergent may have a TBN greater than 200, or 300 to 550, or 350 to 450 mg KOH/g.

A salicylate detergent may be derived from an alkyl-substituted salicylic acid. The TBN of a neutral salicylate may be 50 to 200, or 75 to 175 mg KOH/g. An overbased salicylate may have a TBN of greater than 150 to 400, or 175 to 350 mg KOH/g.

The alkyl group of a salicylate may contain 4 to 80, or 6 to 45, or 8 to 20, or 9 to 18 carbon atoms. In different embodiments the alkyl group of a salicylate may contain 12 or 16 carbon atoms.

Chemical structures for sulphonates, phenates and salicylates detergents are known to a person skilled in the art. The standard textbook entitled "Chemistry and Technology of Lubricants", Third Edition, Edited by R. M. Mortier and S. T. Orszulik, Copyright 2010, pages 220 to 223 under the sub-heading 7.2.6 provide general disclosures of said detergents and their structures.

A saligenin detergent is described in U.S. Pat. No. 7,285,516 in column 3, line 47 to column 5, line 63.

A salixarate detergent is described in U.S. Pat. No. 7,285,516 in column 5, line 64 to column 7, line 53. In general terms a salixarate is derived from coupling a hydrocarbyl-substituted phenol with (an optionally hydrocarbyl-substituted) salicylic acid in the presence of formaldehyde. Salixarate derivatives and methods of their preparation are also described in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate." An overbased salixarate may have a TBN of 170 to 300 mg KOH/g. A neutral salixarate may have a TBN of 50 to less than 170 mg KOH/g.

In one embodiment the detergent may be a carboxylate derived from an aliphatic carboxylic acid. The aliphatic acid may contain 6 to 30, or 7 to 16 carbon atoms. Examples of a suitable carboxylic acid include caprylic acid, capric acid, lauric acid, myristic acid, myristoleic acid, decanoic acid, dodecanoic acid, pentadecanoic acid, palmitic acid, palmitoleic acid, margaric acid, stearic acid, 12-hydroxystearic acid, oleic acid, ricinoleic acid, linoleic acid, arachidic acid, gadoleic acid, eicosadienoic acid, behenic acid, erucic acid, tall oil fatty acids, rapeseed oil fatty acid, linseed oil fatty acid, or mixtures thereof. In one embodiment the aliphatic acids are oleic acid or tall oil fatty acid.

The carboxylate may have a metal ratio of 0.2 to 10, or from 0.5 to 7, or from 0.7 to 5. When overbased, the metal ratio is greater than one.

In one embodiment the acidic or neutralised detergent substrate comprises mixtures of at least two of said substrates. When two or more detergent substrates are used, the overbased detergent formed may be described as a complex/hybrid. The overbased metal-containing detergent may also include "hybrid" detergents formed with mixed surfactant systems including phenate and/or sulphonate components, e.g. phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

The detergent may be a salixarate, a salicylate, a saligenin, a sulphonate, a phenate, or mixtures thereof. Alternatively, the detergent may be a salixarate, a salicylate, or mixtures thereof. The detergent may be a saligenin, a phenate, or mixtures thereof. In one embodiment the detergent may be a sulphonate, a phenate, or mixtures thereof.

The detergent may contain an alkaline earth or alkali metal (typically sodium, barium, calcium, or magnesium), such as calcium or magnesium. Typically the detergent may be zinc, barium sodium, calcium or magnesium salt of a phenate, sulphur-containing phenate, sulphonate, salixarate or salicylate.

The detergent may be borated or non-borated.

The detergent may be present at 0.1 wt % to 1 wt %, or 0.2 wt % to 0.9 wt % or 0.1 wt % to 0.4 wt %, or 0.4 wt % to 1.0 wt %, of the lubricating composition.

Non-Borated Dispersant

The non-borated dispersant of the invention may be a succinimide dispersant, a Mannich dispersant, a succinamide dispersant, a polyolefin succinic acid ester, amide, or ester-amide, or mixtures thereof. In one embodiment the non-borated dispersant may be a succinimide dispersant.

The non-borated dispersant may be an N-substituted long chain alkenyl succinimide, a Mannich base, or mixtures thereof. Examples of N-substituted long chain alkenyl succinimide include polyisobutylene succinimide, wherein the polyisobutylene from which the polyisobutylene succinic anhydride is derived has a number average molecular weight in the range of 350 to 5000, or 500 to 3000, or 750 to 2200, or 750 to 1150.

The non-borated dispersant may be a non-borated succinimide, and the non-borated dispersant may be in a mixture with a borated dispersant (typically a borated polyisobutylene succinimide).

The non-borated dispersant may be formed by reaction of a substituted acylating agent with a polyamine (typically having two or more reactive sites). For example, the substituted acylating agent may be a polyisobutylene succinic anhydride and the polyamine.

The polyamine may be an alkylenepolyamine. The alkylene-polyamine may include an ethylenepolyamine, a propylenepolyamine, a butylenepolyamine, or mixtures thereof. Examples of propylenepolyamine include propylenediamine, dipropylenetriamine and mixtures thereof.

In one embodiment the polyamine is selected from the group consisting of ethylenediamine, diethylenetriamine, tri ethylenetetramine, tetraethylenepentamine, pentaethylenehexamine, polyamine still bottoms and mixtures thereof.

The non-borated dispersant may be a polyisobutylene succinimide derived from an aliphatic polyamine selected from the group consisting of ethyl enediamine, diethyl enetri amine, tri ethyl enetetramine, tetraethylenepent-amine, pentaethylenehexamine, polyamine still bottoms, and mixtures thereof.

The non-borated dispersant may be a polyisobutylene succinimide derived from an aliphatic polyamine selected from the group consisting of tetraethylenepentamine, pentaethylenehexamine, polyamine still bottoms, and mixtures thereof.

The polyamine may also be an α,β-diaminoalkane. Examples of the α,β-diaminoalkane include diaminopropane, diaminobutane or mixtures thereof. Specific diaminoalkanes are selected from the group consisting of N-(2-aminoethyl)-1,3-propane diamine, 3,3 '-diamine-N-methyldipropylamine, tris(2-aminoethyl)amine, N,N-bis(3-aminopropyl)-1,3-propane diamine, N,N'-1,2-ethanediylbis-(1,3-propane diamine) and mixtures thereof.

In one embodiment the polyamine may include di-(trimethylene)-triamine, piperazine, diaminocyclohexanes, or mixtures thereof.

The non-borated dispersant may be prepared/obtained/obtainable from reaction of succinic anhydride by an "ene" or "thermal" reaction, by what is referred to as a "direct alkylation process." The "ene" reaction mechanism and general reaction conditions are summarised in "Maleic Anhydride", pages, 147-149, Edited by B. C. Trivedi and B. C. Culbertson and Published by Plenum Press in 1982. The non-borated dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the non-borated dispersant molecules. The "ene" reaction may have a reaction temperature of 180° C. to less than 300° C., or 200° C. to 250° C., or 200° C. to 220° C.

The non-borated dispersant may also be obtained/obtainable from a chlorine-assisted process, often involving Diels-Alder chemistry, leading to formation of carbocyclic linkages. The process is known to a person skilled in the art. The chlorine-assisted process may produce a non-borated dispersant that is a polyisobutylene succinimide having a carbocyclic ring present on 50 mole % or more, or 60 to 100 mole % of the non-borated dispersant molecules. Both the thermal and chlorine-assisted processes are described in greater detail in U.S. Pat. No. 7,615,521, columns 4-5 and preparative examples A and B.

The non-borated dispersant may have a carbonyl to nitrogen ratio (CO:N ratio) of 5:1 to 1:10, 2:1 to 1:10, or 1:1 to 1:10, or 1:1 to 1:5, or 1:1 to 1:2. In one embodiment the non-borated dispersant may have a CO:N ratio of 1:1 to 1:10, or 1:1 to 1:5, or 1:1 to 1:2.

In one embodiment the non-borated dispersant may be a reaction product of a hydrocarbyl-substituted phenol, an aldehyde, and an amine or ammonia. The hydrocarbyl substituent of the hydrocarbyl-substituted phenol may have 10 to 400 carbon atoms, in another instance 30 to 180 carbon atoms, and in a further instance 10 or 40 to 110 carbon atoms. This hydrocarbyl substituent may be derived from an olefin or a polyolefin. Useful olefins include alpha-olefins, such as 1-decene, which are commercially available.

The non-borated dispersant may be present at (on an oil free basis) 0.01 wt % to 2 wt %, or 0.025 wt % to 1.5 wt %, or 0.025 wt % to 0.4 wt %, or 0.4 wt % to 1.2 wt % of the lubricating composition.

Compound Derived from Hydroxy-Carboxylic Acid

The invention provides a lubricating composition containing a compound derived from a hydroxy-carboxylic acid. The compound derived from a hydroxy-carboxylic acid may be represented by the formula:

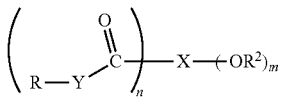

wherein n and m may be independently integers of 1 to 5;

X may be an aliphatic or alicyclic group, or an aliphatic or alicyclic group containing an oxygen atom in the carbon chain, or a substituted group of the foregoing types, said group containing up to 6 carbon atoms and having n+m available points of attachment (that is, although there may be additional valences on X which are satisfied by, e.g., bonding to one or more hydrogen atoms, there will be at least sufficient available valences to attach to the n+m number of groups for the particular hydroxy-carboxylic acid);

each Y may be independently —O—, or >$NR^1$ or two Ys together may represent the nitrogen of an imide structure R—N< formed between two carbonyl groups; and each R and $R^1$ may be independently hydrogen or a hydrocarbyl group, provided that at least one R or $R^1$ group is a hydrocarbyl group; each $R^2$ may be independently hydrogen, a hydrocarbyl group or an acyl group, further provided that at least one —$OR^2$ group is located on a carbon atom within X that is α or β to at least one of the —C(O)—Y—R groups.

The compound derived from the hydroxy-carboxylic acid may be derived from glycolic acid (n and m both equal 1), malic acid (n=2, m=1), tartaric acid (n and m both equal 2), citric acid (n=3, m=1), or mixtures thereof. In one embodiment the compound derived from the hydroxy-carboxylic acid may be derived from tartaric acid or citric acid. In one embodiment the compound derived from the hydroxy-carboxylic acid may be derived from tartaric acid.

The compound derived from the hydroxy-carboxylic acid may be an amide, ester or imide derivative of a hydroxy-carboxylic acid, or mixtures thereof. In one embodiment the compound derived from the hydroxy-carboxylic acid may be an amide, ester or imide derivative of a hydroxy-carboxylic acid. For example the compound derived from the hydroxy-carboxylic acid may an ester or imide of tartaric acid, or the compound derived from the hydroxy-carboxylic acid may an ester or imide of citric acid.

In one embodiment the compound derived from the hydroxy-carboxylic acid may be at least one of a hydroxy-carboxylic acid di-ester, a hydroxy-carboxylic acid di-amide, a hydroxy-carboxylic acid di-imide, a hydroxy-carboxylic acid mono-imide, a hydroxy-carboxylic acid ester-amide, a hydroxy-carboxylic acid ester-imide, and a hydroxy-carboxylic acid imide-amide. In one embodiment the amide, ester or imide derivative of a hydroxy-carboxylic acid may derived from at least one of the group consisting of a hydroxy-carboxylic acid di-ester, a hydroxy-carboxylic acid di-amide, a hydroxy-carboxylic acid mono-imide, and a hydroxy-carboxylic acid ester-amide.

Each R, $R^1$ and $R^2$ group of the compound derived from the hydroxy-carboxylic acid may be a linear or branched alkyl group each having 1 to 150, or 8 to 30, or 8 to 20 carbon atoms. The ester derivatives of the hydroxy-carboxylic acid may be formed by the reaction of an alcohol with hydroxy-carboxylic acid. The alcohol includes both monohydric alcohols and polyhydric alcohols. The carbon atoms of the alcohol may be linear chains, branched chains, or mixtures thereof.

Examples of a suitable branched alcohol include 2-ethylhexanol, iso-tridecanol, iso-octyl alcohol, Guerbet alcohols, or mixtures thereof.

Examples of a monohydric alcohol include methanol, ethanol, propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol, eicosanol, or mixtures thereof. In one embodiment the monohydric alcohol contains 8 to 20 carbon atoms.

In one embodiment the imide derivatives of a hydroxy-carboxylic acid may be tartrimides, typically containing 8 to 20 carbon atoms. Amines used to prepare imides may include alkyl amines (such as n-hexylamine (caproylamine), n-octylamine (caprylylamine), n-decylamine (caprylamine), n-dodecylamine (laurylamine), n-tetradecylamine (myristylamine), n-penta-decylamine, n-hexadecylamine (palmitylamine), margarylamine, n-octadecyl-amine (stearylamine)), unsaturated amines (such as dodecenylamine, myristoleylamine, palmitoleylamine, oleylamine, and linoleylamine), or etheramines (such as those identified as SURFAM™ P14AB (branched C14), SURFAM™ P16A (linear C16), and SURFAM™ P17AB (branched C17)). A detailed description of methods for preparing suitable tartrimides (by reacting tartaric acid with a primary amine) is disclosed in U.S. Pat. No. 4,237,022.

US Patent Applications 2010-0197536 (corresponding to U.S. 60/939,949, filed May 24, 2007) and US 2010-0093573 (corresponding to 60/939,952, filed May 24, 2007) disclose in more detail useful hydroxycarboxylic acid compounds for the present invention.

Canadian Patent 1 183 125; US Patent Publication numbers 2006/0183647 and US-2006-0079413; U.S. Patent Application No. 60/867,402; and British Patent 2 105 743 A, all disclose useful examples of suitable tartaric acid derivatives.

The compound derived from the hydroxy-carboxylic acid may be present at 0.05 wt % to 1.5 wt %, or 0.05 wt % to 1 wt %, or 0.05 wt % to 0.8 wt % of the lubricating composition.

Phosphorus Compounds

The phosphorus compound may be selected from the group consisting of an amine salt of a phosphoric acid ester (typically an amine salt of a phosphoric acid hydrocarbon ester), a phosphite having at least one hydrocarbyl group with 4 or more carbon atoms, a second phosphite having at least one hydrocarbyl group with 4 or more carbon atoms, and mixtures thereof.

In one embodiment the phosphorus compounds may be an amine salt of a phosphoric acid ester (typically a phosphate of a hydrocarbon ester), and a phosphite, wherein the phosphite has at least one hydrocarbyl group with 4 or more carbon atoms.

In one embodiment the phosphorus compounds may be an amine salt of a phosphoric acid ester (typically a phosphate of a hydrocarbon ester), and a phosphite, wherein the phosphite has at least one hydrocarbyl group with 4 or more carbon atoms.

In one embodiment the phosphorus compounds are sulphur-free i.e., the phosphorus compound is not a thiophosphite, nor a thiophosphate.

The amount of phosphorus provided to the lubricating composition by the phosphorus compounds may, in certain embodiments, be 0.02 to 0.2 wt %, or 0.04 to 0.18 wt %, or 0.04 to 0.1 wt % or 0.08 to 0.18 wt % of the lubricating composition.

Amine Salt of a Phosphoric Acid Ester

In one embodiment the lubricating composition contains a phosphorus compound that may be an amine salt of a phosphoric acid ester (typically an amine salt of a hydrocarbon ester of phosphoric acid). The amine salt of the phosphate may be represented by the formula:

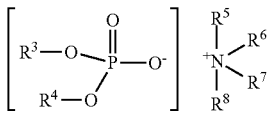

wherein $R^3$ and $R^4$ may be independently hydrogen or a hydrocarbyl group (such as a hydrocarbon group) typically containing 4 to 40, or 6 to 30, or 6 to 18, or 8 to 18 carbon atoms, with the proviso that at least one is a hydrocarbyl group; and $R^5$, $R^6$, $R^7$ and $R^8$ may be independently hydrogen or a hydrocarbyl group, with the proviso that at least one is a hydrocarbyl group. Often the amine salt of a phosphoric acid ester may be a 1:1 mixture of di-and mono-alkyl, i.e., one of $R^3$ or $R^4$ may be hydrogen for half of the moles of the phosphoric acid ester.

The hydrocarbyl groups of $R^3$ and/or $R^4$ may be linear, branched, or cyclic.

Examples of a hydrocarbyl group for $R^3$ and/or $R^4$ include straight-chain or branched alkyl groups, including methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl.

Examples of a cyclic hydrocarbyl group for $R^3$ and/or $R^4$ include cyclopentyl, cyclohexyl, cycloheptyl, methylcyclopentyl, dimethylcyclopentyl, methylcyclopentyl, dimethyl cyclopentyl, methylethylcyclopentyl, diethyl-cyclopentyl, methylcyclohexyl, dimethylcyclohexyl, methylethylcyclohexyl, diethylcyclohexyl, methylcycloheptyl, dimethylcycloheptyl, methylethyl-cycloheptyl, and diethylcycloheptyl.

In one embodiment the amine salt of a phosphoric acid ester is a mixture of monoalkyl and dialkyl phosphoric acid esters. The monoalkyl and dialkyl groups may be linear or branched.

The amine salt of a phosphoric acid ester (typically a hydrocarbon ester) may be derived from an amine such as a primary amine, a secondary amine, a tertiary amine, or mixtures thereof. The amine may be aliphatic, or cyclic, aromatic or non-aromatic, typically aliphatic. In one embodiment the amine includes an aliphatic amine such as a tertiary-aliphatic primary amine.

Examples of suitable primary amines include ethylamine, propylamine, butylamine, 2-ethylhexylamine, bis-(2-ethylhexyl)amine, octylamine, and dodecyl-amine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine, N-methyl-1-amino-cyclo-hexane, Armeen® 2C and ethylamylamine. The secondary amines may be cyclic amines such as piperidine, piperazine and morpholine.

Examples of tertiary amines include tri-n-butylamine, tri-n-octylamine, tri-decylamine, tri-laurylamine, tri-hexadecylamine, and dimethyl-oleylamine (Armeen® DMOD).

In one embodiment the amines are in the form of a mixture. Examples of suitable mixtures of amines include (i) a tertiary alkyl primary amine with 11 to 14 carbon atoms, (ii) a tertiary alkyl primary amine with 14 to 18 carbon atoms, or (iii) a tertiary alkyl primary amine with 18 to 22 carbon atoms. Other examples of tertiary alkyl primary amines include tert-butyl amine, tert-hexyl amine, tert-octylamine (such as 1,1-dimethylhexylamine), tertdecylamine (such as 1,1-dimethyloctylamine), tertdodecylamine, tert-tetradecylamine, tert-hexadecylamine, tert-octadecylamine, tert-tetracosanyl-amine, and tert-octacosanylamine.

In one embodiment a useful mixture of amines is "Primene® 81R" or "Primene® JMT." Primene® 81R and Primene® JMT (both produced and sold by Rohm & Haas) are mixtures of C11 to C14 tertiary alkyl primary amines and C18 to C22 tertiary alkyl primary amines respectively.

The amine salt of a phosphoric acid ester may be prepared as described in U.S. Pat. No. 6,468,946. Column 10, lines 15 to 63 describes phosphoric acid esters formed by reaction of phosphorus compounds, followed by reaction with an amine to form an amine salt of a phosphoric acid ester. Column 10, line 64, to column 12, line 23, describes preparative examples of reactions between phosphorus pentoxide with an alcohol (having 4 to 13 carbon atoms), followed by a reaction with an amine (typically Primene®81-R) to form an amine salt of a phosphoric acid ester.

The amine salt of a phosphoric acid ester may be present at 0.1 wt % to 2.5 wt %, or 0.1 wt % to 1.5 wt %, or 1 wt % to 2 wt %, or 0.1 wt % to 1 wt % of the lubricating composition.

Phosphite

In one embodiment the lubricating composition contains a phosphite, wherein the phosphite has at least one hydrocarbyl group with 4 or more carbon atoms. The phosphite hydrocarbyl group may have 8 or more, or 12 or more carbon atoms. Typical ranges for the number of carbon atoms on the hydrocarbyl group include 4 to 30, or 10 to 24, or 12 to 22, or 14 to 20, or 16 to 18. The phosphite may be a mono-hydrocarbyl substituted phosphite, a di-hydrocarbyl substituted phosphite, or a tri-hydrocarbyl substituted phosphite.

The phosphite may be represented by the formulae:

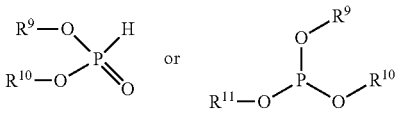

wherein at least one or two of $R^9$, $R^{10}$ and $R^{11}$ may be a hydrocarbyl group containing at least 4 carbon atoms and the other may be hydrogen or a hydrocarbyl group. In one embodiment two or more of $R^9$, $R^{10}$ and $R^{11}$ are hydrocarbyl groups. The hydrocarbyl groups may be alkyl, cycloalkyl, aryl, acyclic or mixtures thereof. In the formula with all three groups $R^9$, $R^{10}$ and $R^{11}$, the compound may be a tri-hydrocarbyl substituted phosphite i.e., $R^9$, $R^{10}$ and $R^{11}$ are all hydrocarbyl groups.

Alkyl groups may be linear or branched, typically linear, and saturated or unsaturated, typically saturated. Examples of alkyl groups for $R^9$, $R^{10}$ and $R^{11}$ include butyl, hexyl, octyl, 2-ethylhexyl, nonyl, decyl, undecyl, dodecyl, tridecyl, tetradecyl, pentadecyl, hexadecyl, heptadecyl, octadecyl, octadecenyl, nonodecyl, eicosyl or mixtures thereof.

Alkyl groups may be linear or branched, typically linear, and saturated or unsaturated, typically saturated. Examples of alkyl groups for $R^9$, $R^{10}$ and $R^{11}$ include butyl, hexyl, octyl, 2-ethylhexyl, nonyl, decyl, undecyl, dodecyl, tridecyl, tetradecyl, pentadecyl, hexadecyl, heptadecyl, octadecyl, octadecenyl, nonodecyl, eicosyl or mixtures thereof. In one embodiment the alkyl groups $R^9$ and $R^{10}$ have 4 carbon atoms (typically n-butyl).

The amine salt of a phosphoric acid hydrocarbon ester and/or, a phosphite having at least one hydrocarbyl group with 4 or more carbon atoms may in one embodiment be in a mixture with one or more of phosphorus acid, phosphoric acid, polyphosphoric acid, a trialkyl phosphate or trialkyl thiophosphate. For instance the amine salt of a phosphoric acid hydrocarbon ester and/or, a phosphite having at least one hydrocarbyl group with 4 or more carbon atoms may in one embodiment be in a mixture with phosphoric acid.

The phosphite compound may be present at 0.05 wt % to 2.0 wt %, or 0.05 wt % to 1.5 wt %, or 0.1 wt % to 1.0 wt % of the lubricating composition.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see [0072] to [0073]). A more detailed description of natural and synthetic lubricating oils is described in paragraphs [0059] respectively of WO2008/147704 (a similar disclosure is provided in US Patent Application 2010/197536, see [0075] to [0076]). Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10). In one embodiment the oil of lubricating viscosity may be an API Group II, Group III, Group IV oil, or mixtures thereof.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Organo-Sulphide

In one embodiment the lubricating composition further comprises an organo-sulphide, or mixtures thereof. In one embodiment the organo-sulphide comprises at least one of a polysulphide, thiadiazole compound, or mixtures thereof.

In different embodiments, the organo-sulphide is present in a range selected from the group consisting of 0 wt % to 10 wt %, 0.01 wt % to 10 wt %, 0.1 wt % to 8 wt %, and 0.25 wt % to 6 wt %; of the lubricating composition.

Thiadiazole Compound

Examples of a thiadiazole include 2,5-dimercapto-1,3,4-thiadiazole, or oligomers thereof, a hydrocarbyl-substituted 2,5-dimercapto-1,3,4-thiadiazole, a hydrocarbylthio-sub stituted 2,5-dimercapto-1,3,4-thiadiazole, or oligomers thereof. The oligomers of hydrocarbyl-substituted 2,5-dimercapto-1,3,4-thiadiazole typically form by forming a sulphur-sulphur bond between 2,5-dimercapto-1,3,4-thiadiazole units to form oligomers of two or more of said thiadiazole units. These thiadiazole compounds may also be used in the post treatment of dispersants as mentioned below in the formation of a dimercaptothiadiazole derivative of a polyisobutylene succinimide.

Examples of a suitable thiadiazole compound include at least one of a dimercaptothiadiazole, 2,5-dimercapto-[1,3,4]-thiadiazole, 3,5-dimercapto-[1,2,4]-thiadiazole, 3,4-dimercapto-[1,2,5]-thiadiazole, or 4-5-dimercapto-[1,2,3]-thiadiazole. Typically readily available materials such as 2,5-di-mercapto-1,3,4-thiadiazole or a hydrocarbyl-substituted 2,5-dimercapto-1,3,4-thiadiazole or a hydrocarbylthio-substituted 2,5-dimercapto-1,3,4-thiadiazole are commonly utilised. In different embodiments the number of carbon atoms on the hydrocarbyl-substituent group includes 1 to 30, 2 to 25, 4 to 20, 6 to 16, or 8 to 10.

In one embodiment, the thiadiazole compound is the reaction product of a phenol with an aldehyde and a dimercaptothiadiazole. The phenol includes an alkyl phenol wherein the alkyl group contains at least 6, e.g., 6 to 24, or 6 (or 7) to 12 carbon atoms. The aldehyde includes an aldehyde containing 1 to 7 carbon atoms or an aldehyde synthon, such as formaldehyde. Useful thiadiazole compounds include 2-alkyldithio-5-mercapto-[1,3,4]-thiadiazoles, 2,5-bis-(alkyl dithio)-[1,3,4]-thiadiazol es, 2-alkylhydroxyphenylmethylthio-5-mercapto-[1,3,4]-thiadiazoles (such as 2-[5-heptyl-2-hydroxyphenylmethylthio]-5-mercapto-[1,3,4]-thiadiazole), and mixtures thereof.

In one embodiment the thiadiazole compound includes at least one of 2,5-bis(tert-octyldithio)-1,3,4-thiadiazole, 2,5-bis(tert-nonyldithio)-1,3,4-thia-diazole, or 2,5-bis(tert-decyldithio)-1,3,4-thiadiazole.

Polysulphide

In one embodiment at least 50 wt % of the polysulphide molecules are a mixture of tri-or tetra-sulphides. In other embodiments at least 55 wt %, or at least 60 wt % of the polysulphide molecules are a mixture of tri- or tetra-sulphides.

The polysulphide includes a sulphurised organic polysulphide from oils, fatty acids or ester, olefins or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulphurised fatty acid esters prepared from mixed unsaturated fatty acid esters such as are obtained from animal fats and vegetable oils, including tall oil, linseed oil, soybean oil, rapeseed oil, and fish oil.

The polysulphide includes olefins derived from a wide range of alkenes. The alkenes typically have one or more double bonds. The olefins in one embodiment contain 3 to 30 carbon atoms. In other embodiments, olefins contain 3 to 16, or 3 to 9 carbon atoms. In one embodiment the sulphurised olefin includes an olefin derived from propylene, isobutylene, pentene or mixtures thereof. Often the sulphurised olefin may be formed in the presence of hydrogen sulphide ($H_2S$).

In one embodiment the polysulphide comprises a polyolefin derived from polymerising by known techniques, an olefin as described above.

In one embodiment the polysulphide includes dibutyl tetrasulphide, sulphurised methyl ester of oleic acid, sulphurised alkylphenol, sulphurised dipentene, sulphurised dicyclopentadiene, sulphurised terpene, and sulphurised Diels-Alder adducts.

Friction Modifier

In one embodiment the lubricating composition further comprises a friction modifier. In different embodiments, the friction modifier is present in a range selected from the group consisting of 0 wt % to 5 wt %, 0.1 wt % to 4 wt %, 0.25 wt % to 3.5 wt %, 0.5 wt % to 2.5 wt %, and 1 wt % to 2.5 wt %, or 0.05 wt % to 0.5 wt % of the lubricating composition.

As used herein the term "fatty alkyl" or "fatty" in relation to friction modifiers means a carbon chain having 10 to 22 carbon atoms, typically a straight carbon chain.

The friction modifier includes fatty amines, borated glycerol esters, fatty acid amides, non-borated fatty epoxides, borated fatty epoxides, alkoxylated fatty amines, borated alkoxylated fatty amines, metal salts of fatty acids, fatty imidazolines, metal salts of alkyl salicylates (may also be referred to as a detergent), metal salts of sulphonates (may also be referred to as a detergent), condensation products of carboxylic acids or polyalkylene-polyamines, or amides of hydroxyalkyl compounds.

In one embodiment the friction modifier includes a fatty acid ester of glycerol. The final product may be in the form of a metal salt, an amide, an imidazoline, or mixtures thereof. The fatty acids may contain 6 to 24, or 8 to 18 carbon atoms. The fatty acids may branched or straight-chain, saturated or unsaturated. Suitable acids include 2-ethylhexanoic, decanoic, oleic, stearic, isostearic, palmitic, myristic, palmitoleic, linoleic, lauric, and linolenic acids, and the acids from the natural products tallow, palm oil, olive oil, peanut oil, corn oil, and Neat's foot oil. In one embodiment the fatty acid is oleic acid. When in the form of a metal salt, typically the metal includes zinc or calcium; and the products include overbased and non-overbased products. Examples are overbased calcium salts and basic oleic acid-zinc salt complexes which can be represented by the general formula $Zn_4Oleate_6O$. When in the form of an amide, the condensation product includes those prepared with ammonia, or with primary or secondary amines such as diethylamine and diethanolamine. When in the form of an imidazoline, the condensation product of an acid with a diamine or polyamine such as a polyethylenepolyamine. In one embodiment the friction modifier is the condensation product of a fatty acid with C8 to C24 atoms, and a polyalkylene polyamine, and in particular, the product of isostearic acid with tetraethylenepentamine.

In one embodiment the friction modifier includes those formed by the condensation of the hydroxyalkyl compound with an acylating agent or an amine. A more detailed description of the hydroxyalkyl compound is described in WO2007/0044820 paragraphs 9, and 20-22. The friction modifier disclosed in WO2007/044820 includes an amide represented by the formula $R^{12}R^{13}N—C(O)R^{14}$, wherein $R^{12}$ and $R^{13}$ are each independently hydrocarbyl groups of at least 6 carbon atoms and $R^{14}$ is a hydroxyalkyl group of 1 to 6 carbon atoms or a group formed by the condensation of said hydroxyalkyl group, through a hydroxyl group thereof, with an acylating agent. Preparative Examples are disclosed in Examples 1 and 2 (paragraphs 72 and 73 of WO2007/044820). In one embodiment the amide of a hydroxylalkyl compound is prepared by reacting glycolic acid, that is, hydroxyacetic acid, $HO—CH_2—COOH$ with an amine.

In one embodiment the friction modifier includes a secondary or tertiary amine being represented by the formula $R^{15}R^{16}NR^{17}$, wherein $R^{15}$ and $R^{16}$ are each independently an alkyl group of at least 6 carbon atoms and $R^{17}$ is hydrogen, a hydrocarbyl group, a hydroxyl-containing alkyl group, or an amine-containing alkyl group. A more detailed description of the friction modifier is described in US Patent Application 2005/037897 in paragraphs 8 and 19 to 22.

In one embodiment the friction modifier includes a reaction product of a di-cocoalkyl amine (or di-cocoamine) with glycolic acid. The friction modifier includes compounds prepared in Preparative Examples 1 and 2 of WO 2008/014319.

In one embodiment the friction modifier includes those derived from the reaction product of a carboxylic acid or a reactive equivalent thereof with an aminoalcohol, wherein the friction modifier contains at least two hydrocarbyl groups, each containing at least 6 carbon atoms. An example of such a friction modifier includes the reaction product of isostearic acid or an alkyl succinic anhydride with tris-hydroxymethylaminomethane. A more detailed description of such a friction modifier is disclosed in US Patent Application 2003/22000 (or International Publication WO04/007652) in paragraphs 8 and 9 to 14.

In one embodiment the friction modifier includes an alkoxylated alcohol. A detailed description of suitable alkoxylated alcohols is described in paragraphs 19 and 20 of US Patent Application 2005/0101497. The alkoxylated amines are also described in U.S. Pat. No. 5,641,732 in column 7, line 15 to column 9, line 25.

In one embodiment the friction modifier includes a hydroxyl amine compound as defined in column 37, line 19, to column 39, line 38 of U.S. Pat. No. 5,534,170. Optionally the hydroxyl amine includes borated as such products are described in column 39, line 39 to column 40 line 8 of U.S. Pat. No. 5,534,170.

In one embodiment the friction modifier includes an alkoxylated amine e.g., an ethoxylated amine derived from 1.8% Ethomeen™ T-12 and 0.90% Tomah™ PA-1 as described in Example E of U.S. Pat. No. 5,703,023, column 28, lines 30 to 46. Other suitable alkoxylated amine compounds include commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]-coco-amine); ETHOMEEN™ C/20 (polyoxyethylene[10] cocoamine); ETHOMEEN™ S/12 (bis[2-hydroxyethyl] soyamine); ETHOMEEN™ T/12 (bis[2-hydroxyethyl] allow-amine); ETHOMEEN™ T/15 (polyoxyethylene-[5] tallowamine); ETHOMEEN™ 0/12 (bis[2-hydroxyethyl] oleyl-amine); ETHOMEEN™ 18/12 (bis[2-hydroxyethyl] octadecylamine); and ETHOMEEN™ 18/25 (polyoxyethylene[15]octadecylamine). Fatty amines and ethoxylated fatty amines are also described in U.S. Pat. No. 4,741,848.

In one embodiment the friction modifier includes a polyol ester as described in U.S. Pat. No. 5,750,476 column 8, line 40 to column 9, line 28.

In one embodiment the friction modifier includes a low potency friction modifier as described in U.S. Pat. No. 5,840,662 in column 2, line 28 to column 3, line 26. U.S. Pat. No. 5,840,662 further discloses in column 3, line 48 to column 6, line 25 specific materials and methods of preparing the low potency friction modifier.

In one embodiment the friction modifier includes a reaction product of an isomerised alkenyl substituted succinic anhydride and a polyamine as described in U.S. Pat. No. 5,840,663 in column 2, lines 18 to 43. Specific embodiments of the friction modifier described in U.S. Pat. No. 5,840,663 are further disclosed in column 3, line 23 to column 4, line 35. Preparative examples are further disclosed in column 4, line 45 to column 5, line 37 of U.S. Pat. No. 5,840,663.

In one embodiment the friction modifier includes an alkylphosphonate mono- or di-ester sold commercially by Rhodia under the trademark Duraphos® DMODP.

In one embodiment the friction modifier includes a borated fatty epoxide or alkylene oxide, known from Canadian Patent No. 1,188,704. These oil-soluble boron-containing compositions are prepared by reacting, at a temperature of 80° C. to 250° C., boric acid or boron trioxide with at least one fatty epoxide or alkylene oxide. The fatty epoxide or alkylene oxide typically contains at least 8 carbon atoms in the fatty groups of the epoxide (or the alkylene groups of the alkylene oxide).

The borated fatty epoxides include those characterised by the method for their preparation which involves the reaction of two materials. Reagent A includes boron trioxide or any of the various forms of boric acid including metaboric acid ($HBO_2$), orthoboric acid ($H_3BO_3$) and tetraboric acid ($H_2B_4O_7$), or orthoboric acid. Reagent B includes at least one fatty epoxide. The molar ratio of reagent A to reagent B is generally 1:0.25 to 1:4, or 1:1 to 1:3, or 1:1 to 1:2. The borated fatty epoxides includes compounds prepared by blending the two reagents and heating them at temperature of 80° C. to 250° C., or 100° C. to 200° C., for a period of time sufficient for reaction to take place. If desired, the reaction may be effected in the presence of a substantially inert, normally liquid organic diluent. During the reaction, water is evolved and may be removed by distillation.

Other Performance Additive

The composition of the invention optionally further includes at least one other performance additive. The other performance additives include metal deactivators, dispersants (other than the non-borated dispersant of the present invention), viscosity modifiers, dispersant viscosity modifiers, antioxidants, corrosion inhibitors, foam inhibitors, demulsifiers, pour point depressants, seal swelling agents, phosphoric acid, and mixtures thereof.

In different embodiments, the total combined amount of the other performance additive compounds is present in a range selected from the group consisting of 0 wt % to 75 wt %, 0.1 wt % to 50 wt %, and 0.5 wt % to 30 wt %, 0.5 wt % to 15 wt % or to 10 wt %, of the lubricating composition. Although one or more of the other performance additives may be present, it is common for the other performance additives to be present in different amounts relative to each other.

Antioxidants include molybdenum compounds such as molybdenum dithiocarbamates, sulphurised olefins, hindered phenols, aminic compounds such as phenyl-a-naphthylamine (PANA) or alkylated diphenylamines (typically di-nonyl diphenylamine, octyl diphenylamine, or di-octyl diphenylamine).

Viscosity modifiers include hydrogenated copolymers of styrene-butadiene, ethylene-propylene copolymers, polyisobutenes, hydrogenated styrene-isoprene polymers, hydrogenated isoprene polymers, polymethacrylate acid esters, polyacrylate acid esters, polyalkyl styrenes, alkenyl aryl conjugated diene copolymers, polyolefins, polyalkylmethacrylates and esters of maleic anhydride-styrene copolymers. Dispersant viscosity modifiers (often referred to as DVM) include functionalised polyolefins, for example, ethylene-propylene copolymers that have been functionalized with the reaction product of maleic anhydride and an amine, a polymethacrylate functionalised with an amine, or styrenemaleic anhydride copolymers reacted with an amine; may also be used in the composition of the invention.

Corrosion inhibitors include 1-amino-2-propanol, amines, triazole derivatives including tolyl triazole, dimercaptothiadiazole derivatives, octylamine octanoate, condensation products of dodecenyl succinic acid or anhydride and/or a fatty acid such as oleic acid with a polyamine.

Foam inhibitors that may be useful in the compositions of the invention include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulfolene derivatives, Exxon Necton-37™ (FN 1380) and Exxon Mineral Seal Oil™ (FN 3200).

In different embodiments the lubricating composition of the invention may or may not contain phosphoric acid.

INDUSTRIAL APPLICATION

The method of the invention is useful for lubricating a variety of driveline devices applications. The driveline device comprises at least one of a gear, a gearbox, an axle gear, a traction drive transmission, an automatic transmission or a manual transmission. In one embodiment the driveline device is a manual transmission or a gear, a gearbox, or an axle gear.

An automatic transmission includes continuously variable transmissions (CVT), infinitely variable transmissions (IVT), toroidal trans-missions, continuously slipping torque converter clutches (CSTCC), stepped automatic transmissions or dual clutch transmissions (DCT).

Automatic transmissions can contain continuously slipping torque converter clutches (CSTCC), wet start and shifting clutches and in some cases may also include metal or composite synchronizers.

Dual clutch transmissions or automatic transmissions may also incorporate electric motor units to provide a hybrid drive.

A manual transmission lubricant may be used in a manual gearbox which may be unsynchronized or may contain a synchronizer mechanism. The gearbox may be self-contained or may additionally contain any of a transfer gearbox, planetary gear system, differential, limited slip differential or torque vectoring device, which may be lubricated by a manual transmission fluid.

The gear oil or axle oil may be used in a planetary hub reduction axle, a mechanical steering and transfer gear box in utility vehicles, a synchromesh gear box, a power take-off gear, a limited slip axle, and a planetary hub reduction gear box.

Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated.

The following examples provide illustrations of the invention. These examples are non-exhaustive and are not intended to limit the scope of the invention.

EXAMPLES

A series of gear oil lubricants are prepared containing an amount of each of the following: (a) an amine salt of a phosphoric acid, (b) a phosphite, (c) a derivative of a hydroxy-carboxylic acid, (d) a polyisobutylene succinimide (non-borated), (e) a detergent, and 36.5 wt % actives of a viscosity modifier. The lubricants contain amounts shown in the following table:

| | Amounts Quoted on wt % basis | | | | |
|---|---|---|---|---|---|
| Example | (a) | (b) | (c) | (d) | (e) |
| EX1 | 1.4 | 0.20 | 0.10 | 2.00 | 0.55 |
| EX2 | 1.4 | 0.35 | 0.10 | 2.00 | 1.37 |
| EX3 | 1.4 | 0.50 | 0.10 | 2.00 | 1.37 |
| EX4 | 1.0 | 0.50 | 0.25 | 2.00 | 1.37 |
| EX5 | 1.3 | 0.50 | 0.20 | 1.30 | 0.78 |
| EX6 | 1.1 | 0.50 | 0.25 | 2.00 | 1.37 |
| EX7 | 1.3 | 0.90 | 0.30 | 1.50 | 0.98 |
| EX8 | 1.7 | 0.90 | 0.50 | 0.00 | 1.37 |
| EX9 | 1.0 | 0.86 | 0.10 | 1.95 | 1.37 |
| EX10 | 1.8 | 0.46 | 0.10 | 1.25 | 1.37 |
| EX11 | 1.0 | 0.50 | 0.05 | 1.50 | 0.50 |
| EX12 | 1.5 | 0.30 | 0.20 | 1.50 | 0.50 |
| EX13 | 1.4 | 0.10 | 0.25 | 1.50 | 0.75 |
| EX14 | 1.3 | 0.50 | 0.10 | 2.00 | 0.75 |
| EX15 | 1.5 | 0.70 | 0.20 | 1.20 | 1.42 |
| EX16 | 1.1 | 0.85 | 0.30 | 2.00 | 0.50 |
| EX17 | 2.0 | 0.90 | 0.10 | 1.50 | 0.25 |
| EX18 | 1.0 | 0.86 | 0.20 | 1.95 | 0.75 |
| EX19 | 1.0 | 0.50 | 0.20 | 1.95 | 0.30 |

Footnote:
Amounts quoted for (d) include 14-50 wt % of diluent oil.
Examples 1-10 are SAE grade 75W-90 fluids containing a magnesium detergent, and the quantity shown includes 39 wt % of diluent oil.
Example 11-18 are SAE grade 75W-90 fluids containing a calcium detergent and the quantity shown includes 42 wt % of diluent oil.

A series of gear oil lubricants are prepared containing an amount of each of the following: (a) an amine salt of a phosphoric acid, (b) a phosphite, (c) a derivative of a hydroxy-carboxylic acid, (d) a polyisobutylene succinimide (non-borated), (e) a detergent, and 5 wt % actives of a viscosity modifier. The lubricants contain amounts shown in the following table:

| | Amounts Quoted on wt % basis | | | | |
|---|---|---|---|---|---|
| Example | (a) | (b) | (c) | (d) | (e) |
| EX20 | 0.50 | 0.30 | 0.05 | 0.05 | 0.25 |
| EX21 | 0.10 | 0.10 | 0.10 | 0.20 | 0.25 |
| EX22 | 0.37 | 0.18 | 0.10 | 0.75 | 0.8 |
| EX23 | 0.37 | 0.18 | 0.10 | 0.75 | 0.625 |
| EX24 | 0.60 | 0.30 | 0.10 | 0.10 | 0.75 |
| EX25 | 0.60 | 0.10 | 0.15 | 0.10 | 0.75 |

-continued

| Example | Amounts Quoted on wt % basis | | | | |
|---|---|---|---|---|---|
| | (a) | (b) | (c) | (d) | (e) |
| EX26 | 0.20 | 0.30 | 0.10 | 0.10 | 0.75 |
| EX27 | 0.50 | 0.10 | 0.15 | 0.10 | 0.75 |

Footnote:-

Amounts quoted for (d) include 14-50 wt % of diluent oil.

Examples 20-27 are SAE grade 75W-80 fluids containing a calcium detergent, and the quantity shown includes 42 wt % of diluent oil.

Overall, the compositions of the invention have performance benefits over comparative examples in least one of (i) wear, (ii) scuffing, (iii) fatigue, (iv) ridging, (v) extreme pressure performance, (vi) fuel economy/efficiency (typically improving fuel economy/efficiency), (vii) oxidation control (typically reducing or preventing oxidation), (viii) friction performance and (ix) deposit control.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

As used herein the term "fatty" as in fatty acid (and other expressions used herein) includes a hydrocarbyl chain containing 4 to 150, or 4 to 30, or 6 to 16 carbon atoms.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of lubricating a driveline device comprising supplying a lubricating composition to the driveline device, wherein the driveline device contains a synchronizer or axle, and wherein the lubricating composition comprises:

an oil of lubricating viscosity, 0.01 wt % to 2 wt % of a non-borated dispersant, 0.1 wt % to 1 wt % of a detergent, and an antiwear package comprising (a) 0.05 wt % to 1.5 wt % of an amide, ester, or imide of tartaric or citric acid, (b) 0.1 wt % to 2.5 wt % of an amine salt of a phosphoric acid ester represented by the formula:

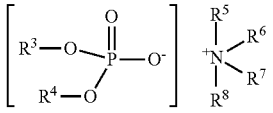

wherein $R^3$ and $R^4$ are independently hydrogen or a hydrocarbyl group containing 4 to 18 carbon atoms, with the proviso that at least one is a hydrocarbyl group; and $R^5$, $R^6$, $R^7$ and $R^8$ are independently hydrogen or a hydrocarbyl group, with the proviso that at least one is a hydrocarbyl group, and (c) 0.1 wt % to 1.0 wt % of a phosphite represented by the formulae:

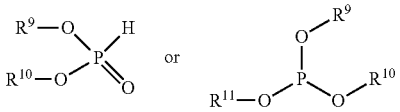

wherein at least two of $R^9$, $R^{10}$ and $R^{11}$ is a hydrocarbyl group containing 4 to 20 carbon atoms and the other is hydrogen or a hydrocarbyl group containing 4 to 20 carbon atoms.

2. The method of claim 1, wherein the synchronizer operating surface comprises brass, carbon, molybdenum, phenolic resin, or a sintered metal or mixtures thereof.

3. The method of claim 1, wherein the lubricating composition comprises:

an oil of lubricating viscosity, 0.4 wt % to 1.2 wt % of a non-borated dispersant, 0.4 wt % to 1.0 wt % of a detergent, and an antiwear package comprising (a) 0.05 wt % to 0.8 wt % of an amide, ester, or imide of tartaric or citric acid, (b) 0.1 wt % to 1 wt % of an amine salt of a phosphoric acid ester, and (c) 0.1 wt % to 1.0 wt % of a phosphite.

4. The method of claim 1, wherein the detergent is a sulphonate, a phenate, or mixtures thereof.

5. The method of claim 4, wherein the phenate is an alkyl phenate, an aldehyde-coupled alkyl phenate, a sulphurised alkyl phenate, or mixtures thereof.

6. The method of claim 1, wherein the non-borated dispersant is a succinimide dispersant, or mixtures thereof.

7. The method of claim 1, wherein the non-borated dispersant is a polyisobutylene succinimide, wherein the polyisobutylene from which the polyisobutylene succinimide is derived has a number average molecular weight in the range of 350 to 5000.

8. The method of claim 1, wherein the non-borated dispersant is a non-borated succinimide, and wherein the non-borated dispersant is in a mixture with a borated dispersant.

9. The method of claim 1, wherein the non-borated dispersant is a polyisobutylene succinimide derived from an aliphatic polyamine selected from the group consisting of ethylenediamine, diethylenetriamine, triethylenetetramine, tetra-ethylenepentamine, pentaethylenehexamine, polyamine still bottoms, and mixtures thereof.

10. The method of claim 1, wherein the non-borated dispersant is a polyisobutylene succinimide derived from an aliphatic polyamine selected from the group consisting of tetraethylenepentamine, pentaethylenehexamine, polyamine still bottoms, and mixtures thereof.

* * * * *